United States Patent [19]
Eubanks et al.
[11] 4,239,093
[45] Dec. 16, 1980

[54] LUGGAGE CASE WITH BRACE

[75] Inventors: Jerry D. Eubanks, Westminster; Charles F. Rose, Aurora, both of Colo.

[73] Assignee: Samsonite Corporation, Denver, Colo.

[21] Appl. No.: 44,459

[22] Filed: Jun. 1, 1979

[51] Int. Cl.[3] ..... A45C 13/34
[52] U.S. Cl. ..... 190/41 R; 217/60 D; 220/335
[58] Field of Search ..... 220/335; 190/41 R, 19; 217/60 R, 60 B, 60 C, 60 D; 16/138, 147, 191

[56] References Cited

U.S. PATENT DOCUMENTS

| | | | |
|---|---|---|---|
| 540,854 | 6/1895 | Choate . | |
| 1,326,333 | 12/1919 | Frank . | |
| 1,862,868 | 6/1932 | Sukoff | 217/60 D X |
| 2,115,656 | 4/1938 | Thompson | 217/60 C |
| 2,684,169 | 7/1954 | Elerding . | |
| 2,842,278 | 7/1958 | Murphy | 217/60 D |
| 3,034,551 | 5/1962 | Klehr . | |

FOREIGN PATENT DOCUMENTS

| | | | |
|---|---|---|---|
| 1425 | of 1910 | United Kingdom | 217/60 D |

*Primary Examiner*—Donald F. Norton
*Attorney, Agent, or Firm*—George J. Netter

[57] ABSTRACT

A first version includes a flat, plate-like member of resilient synthetic plastic having one end pivotally connected to a stud affixed to the inner end wall surface of one luggage shell. One of a pair of elongated, parallel curved slots formed in the plate is received onto a second stud affixed to the other luggage parts such that when the two luggage parts are opened or closed on each other, the stud will slide along and be guided by the slot. The second stud has cross-sectional dimensions larger than the slot width which distends the plastic material between the two slots producing a resilient clamping action on the stud.

A second version includes a metal plate with an end pivotally connected to a stud on the inner surface of one shell. A slot in the plate is received onto a stud on the other luggage shell such that the stud will slide along and be guided by the slot. A thickened ear is located immediately adjacent the slot as a stop. A spring and washer on the stud exert transverse pressure on the plate as the stud moves along the slot deterring any tendency for the case parts to slam together.

3 Claims, 13 Drawing Figures

FIG. 1.
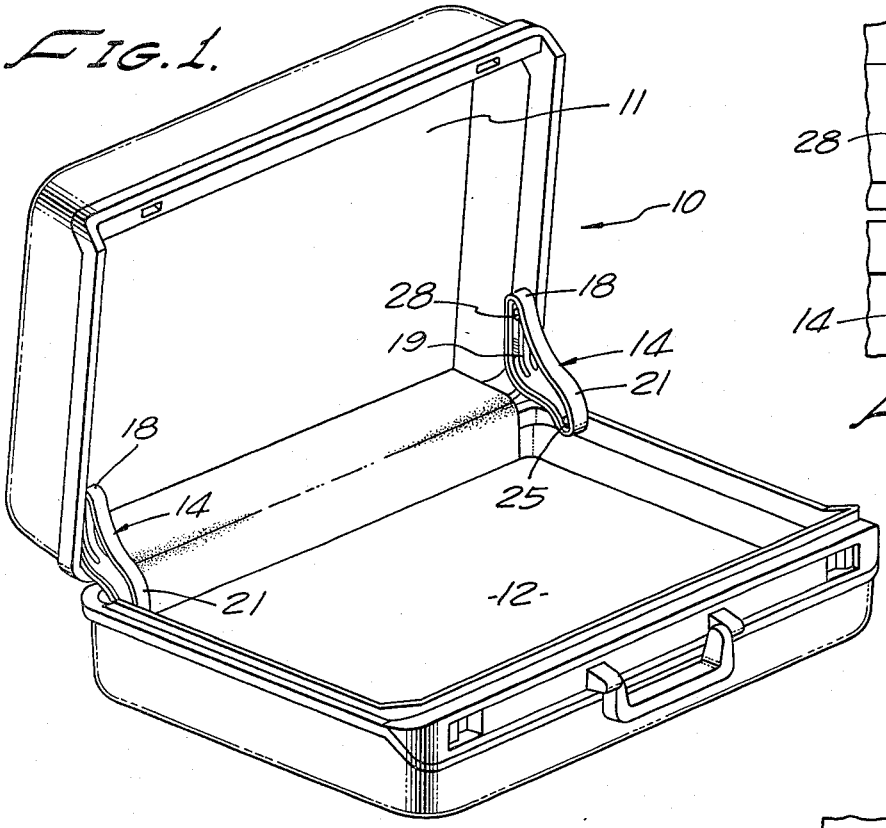
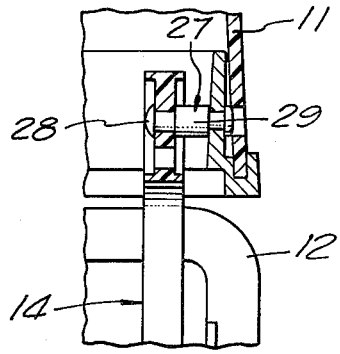
FIG. 4.
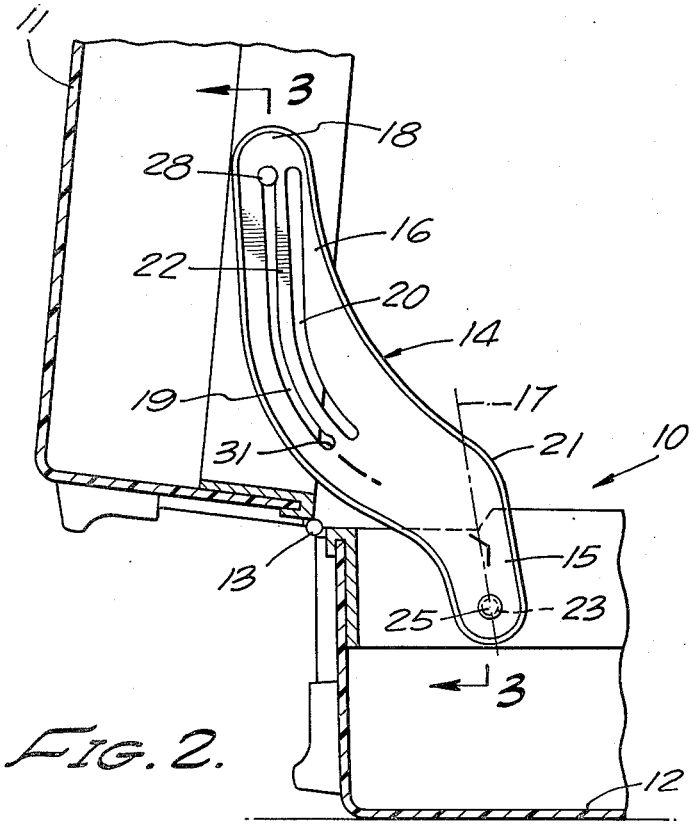
FIG. 2.
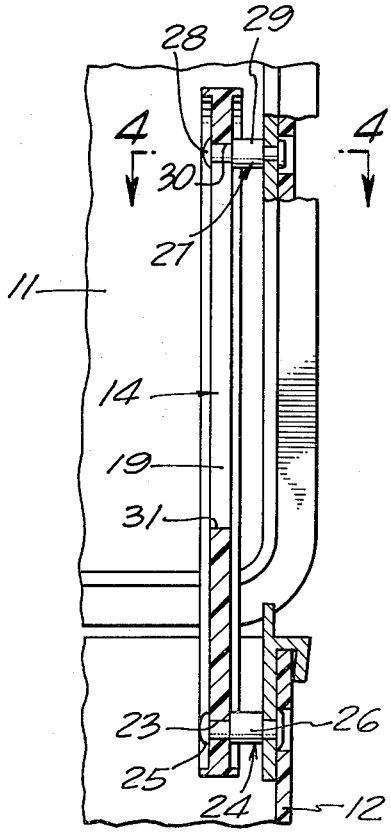
FIG. 3.

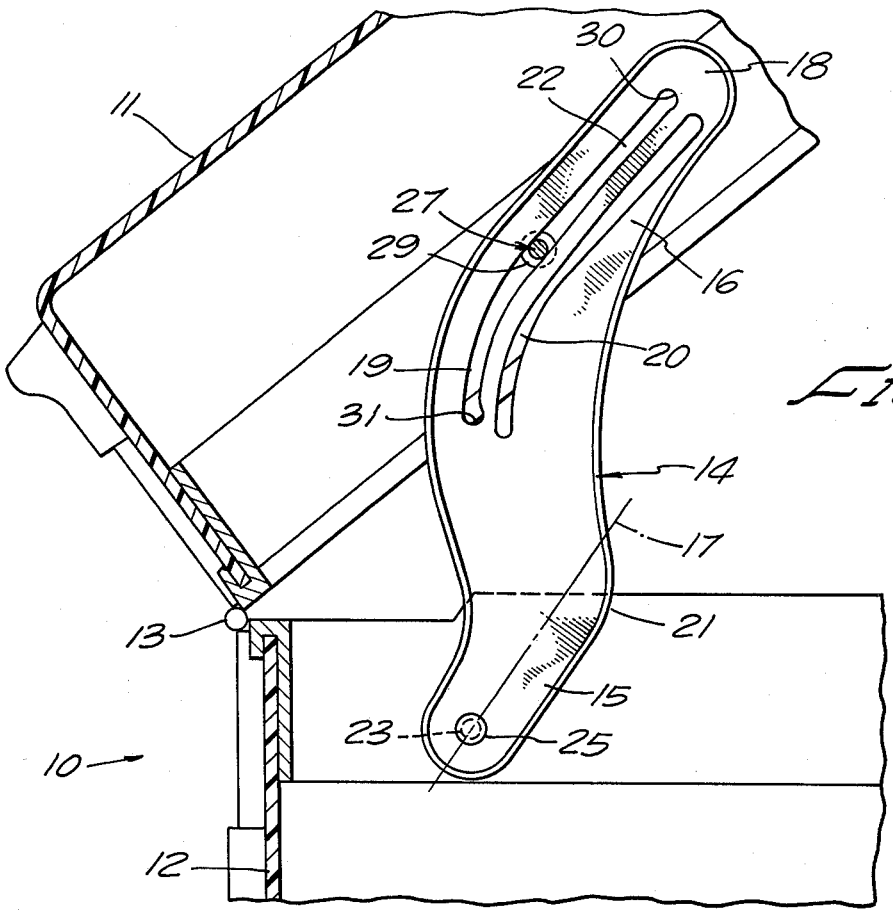
FIG. 5.
FIG. 6.
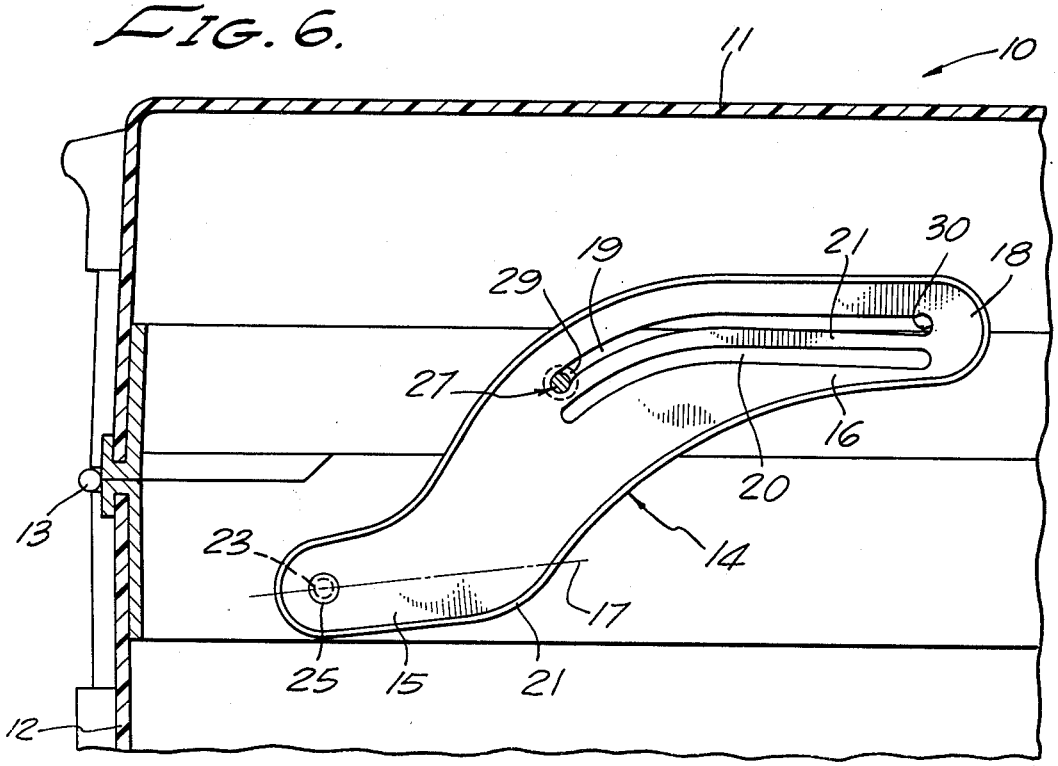

FIG. 11.
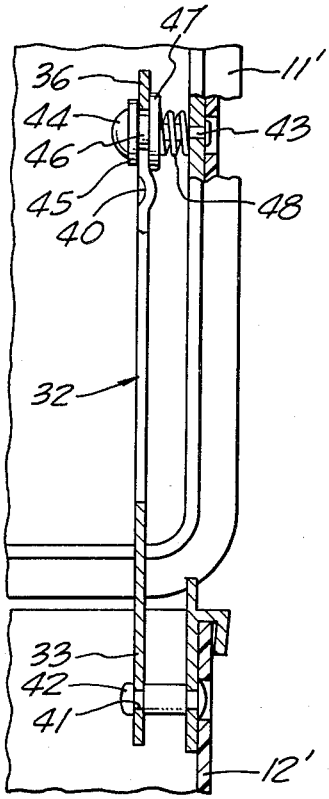
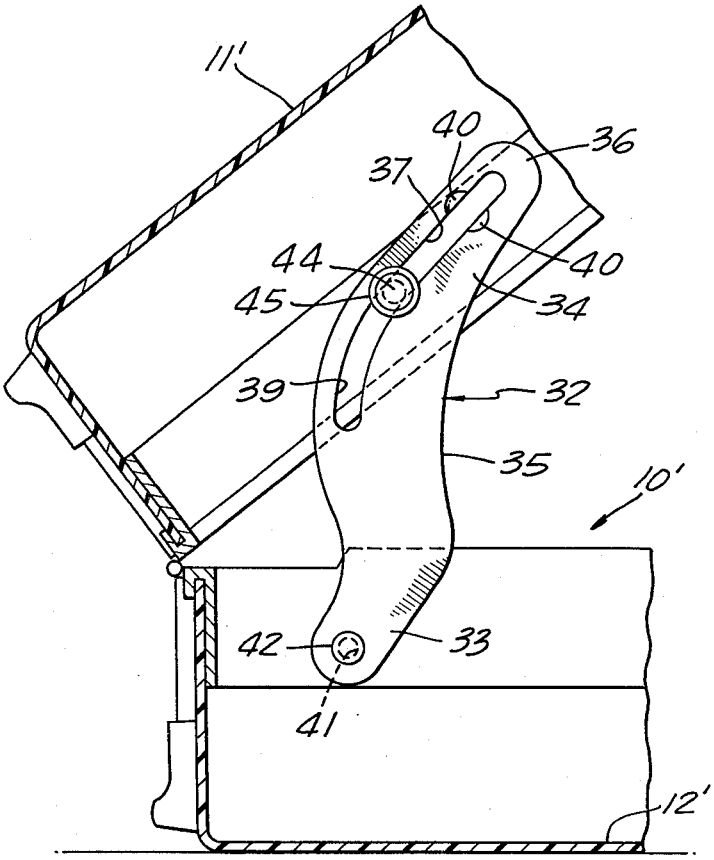
FIG. 12.
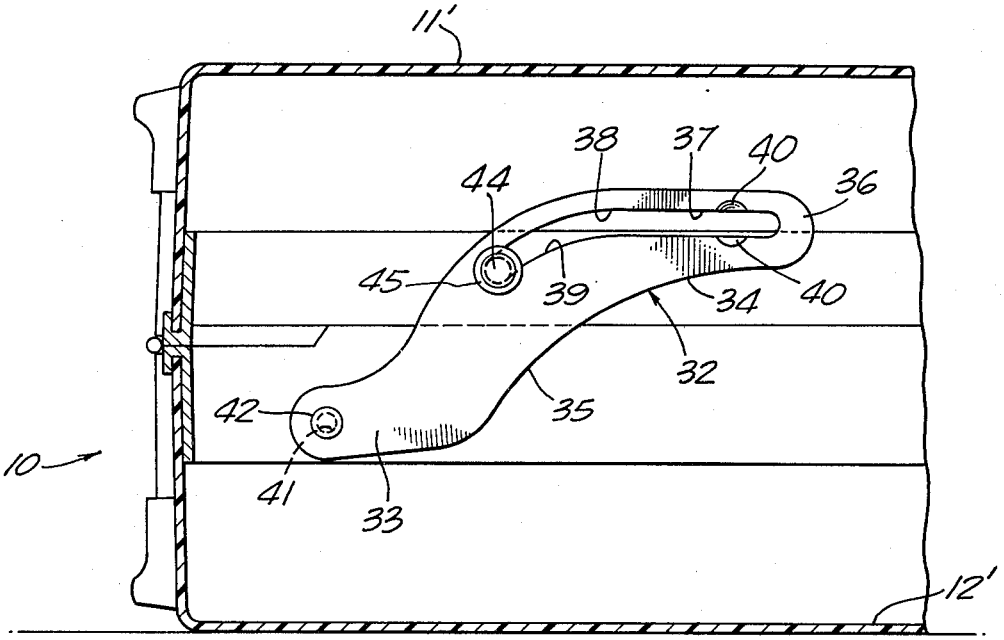
FIG. 13.

LUGGAGE CASE WITH BRACE

The present invention relates generally to a carrying case, and more particularly, to an improvement in such a brace or stay for use in a sample case, business luggage case, luggage generally, or other carrying case.

BACKGROUND OF THE INVENTION

It is advantageous in carrying cases, and especially in business luggage cases (i.e., briefcases, attache cases) that some means, such as a brace or a stay, be provided to hold the case parts separated so that the user may place papers therein or take them out without the lid slamming shut. To be fully satisfactory, such a brace or stay should occupy a minimum amount of interior space of the case and should not pose a threat to the hands of the user or damage papers contained in the case during opening and closing. A well-known prior brace consists of a pair of arms pivotally interconnected, the outer ends of which are pivotally joined to the case halves such that when the case is fully open, the arms releasably lock into a straight member preventing inadvertent closing of the case. This known type of brace or stay is not completely satisfactory in that the pinching action between the two arms can tear or otherwise damage papers contained within the case, and it also can inflict injury on the fingers of the user.

SUMMARY OF THE INVENTION

The carrying case may be of conventional construction including a pair of shell-like parts joined together along a common edge by a hinge. A first form of brace to be described is interconnected with both of the case parts end walls adjacent the hinge, and, more particularly, includes a flat, plate-like member of resilient synthetic plastic having one end pivotally connected to a stud affixed to the inner end wall surface of one of the luggage parts. The plate has a pair of elongated, parallel curved slots, one of which is received onto a stud affixed to the other case part such that when the two parts are opened or closed on each other, the stud will slide along and be guided by the slot. The stud or pin received within the slot has cross-sectional dimensions slightly larger than those of the slot which distends the plastic material between the two slots thereby producing a resilient clamping action on the stud. The outermost end of the guide slot is larger than the stud or pin so that when the case is fully open and the stud is located in the large slot end, the slot will close down somewhat below the stud preventing the case from closing by gravity alone.

In accordance with a second version, the brace includes a flat metal plate having one end pivotally connected to a stud affixed to the inner surface of one of the luggage parts end walls. The plate has an elongated curved slot received onto a stud affixed to the other case part such that when the two parts are opened or closed on each other, the stud will slide along and be guided by the slot. At the outer extremity of the slot, the metal plate is formed to provide a thickened ear immediately adjacent the end portion thereof. A spring and washer are provided on the stud exerting clamping pressure transversely of the plate as the stud moves along the slot. In use, the clamping pressure deters any tendency for the case parts to slam together. When the stud is positioned at the outer extremity of the slot, the combination of the thickened part of the plate and the spring pressure will secure it firmly in open relation.

DESCRIPTION OF THE DRAWINGS

FIG. 1 is a perspective view of a carrying case and brace of the invention shown holding the case parts open.

FIG. 2 is an enlarged elevational, sectional partially fragmentary view of the case and brace of FIG. 1.

FIG. 3 is a sectional, elevational view taken along the line 3—3 of FIG. 2.

FIG. 4 is a sectional view taken along the line 4—4 of FIG. 3.

FIG. 5 is a sectional, elevational view similar to FIG. 2 showing the case partly closed.

FIG. 6 is an elevational view similar to FIGS. 2 and 5 showing the case entirely closed.

FIG. 11 is a front elevational, partially sectional view of that portion of the case including the brace.

FIG. 12 is a figure similar to FIG. 8 showing the case partially closed.

FIG. 13 is an elevational view similar to FIGS. 8 and 12 showing the case entirely closed.

DESCRIPTION OF PREFERRED EMBODIMENTS

Figure 7:
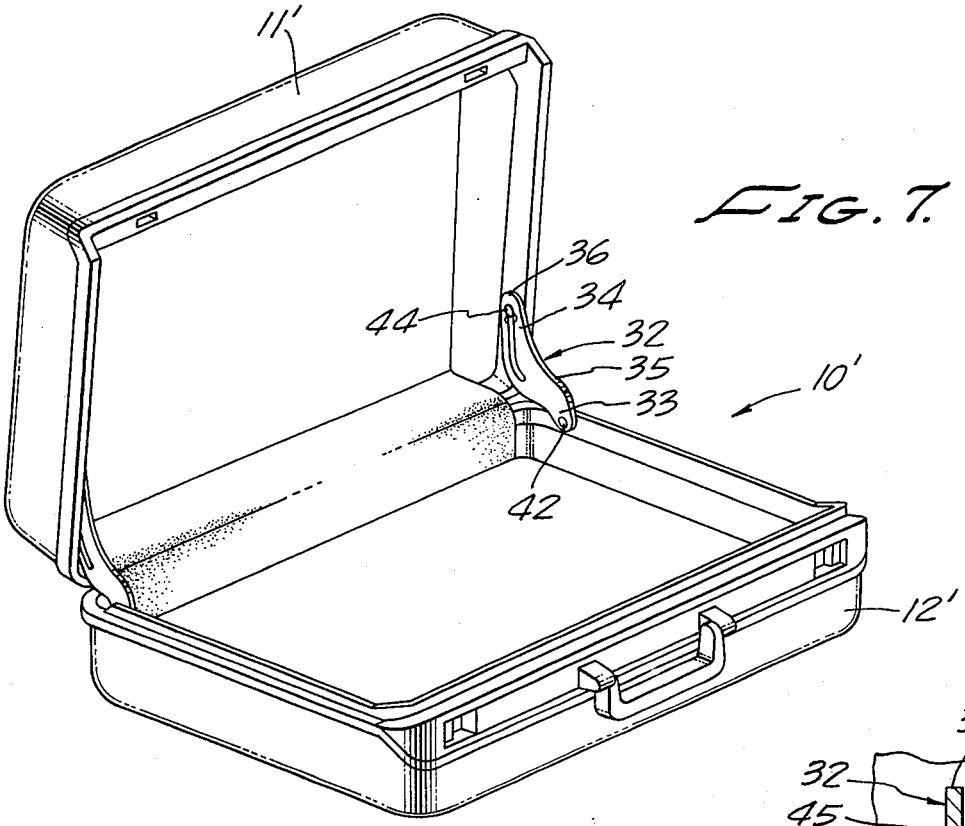
FIG. 7 is a perspective view of a carrying case and alternative form of brace of the invention.

With reference now to the drawings, and particularly FIG. 1, a typical business paper luggage case, attache case or briefcase, is shown generally as at 10, and is seen to include a pair of luggage case parts or shells 11 and 12 which are related together along a common edge by a hinge 13 permitting the case parts to be closed and opened onto each other. A first version of the brace or stay 14 of the invention is shown interconnected adjacent the hinge 13 to the internal walls of the case end walls, and, in a way that will be described, serves to releasably lock the cases in the open position depicted in FIG. 1, and during closing to provide sufficient resistance to the closing movement to prevent the case parts slamming onto each other possibly injuring the fingers of the user. Moreover, the construction of the stay or brace 14 is such that it will not tend to pinch or tear papers contained within the case, and, in addition, the brace only takes up a minimum amount of space from the interior of the case when the case parts 11 and 12 are fully closed on each other.

Turning now to FIG. 2, the brace or stay 14 is seen to include an elongated, one-piece plate-like member having a first generally straight-line portion 15 and a second curved portion 16 integral therewith. The straight-line portion 15 extends along an axis 17 that is spaced outwardly of the curved portion 16 thereby locating the end 18 eccentrically with respect to 15.

The curved portion 16 of the brace 14 includes a pair of parallel, elongated slots 19 and 20, each having a relatively straight-line portion extending from end points immediately adjacent the brace end 18 for length of approximately one-third the entire length of the brace 14. The centerlines of the slot straight-line portions approach the axis 17 at a small angle. The straight-line portions of the slots continue as parallel curved portions which turn toward the brace straight-line portion 15, the curved lengths of which are slightly less than that of the slot straight-line portions.

The brace 14 is preferably molded from a resilient synthetic plastic into a generally flat, platelike member having its outer peripheral edge defined by a thickened flange. The spacing of the slots 19 and 20 from one another is such as to form a strip 22 of plastic lying therebetween which can readily flex in the general plane of the brace.

The brace straight-line portion 15 includes an opening 23 which is rotatably received onto a stud 24 affixed to the inner end wall of the case part 12 and extends into the case interior generally parallel to the axis of hinge 13. The stud has a large head 25 and shoulder 26 to maintain the brace at a constant spacing from the case part end wall.

A further stud 27 is secured to the inner end wall of the case part 11 adjacent to the hinge and extends generally parallel to the hinge. The stud 27 passes through the slot 19 and includes an oversize head 28 preventing removal of the brace from the stud, and an enlarged shoulder 29 for maintaining a fixed spaced relation of the brace from the case end wall.

The part of the stud 27 which is received within the slot 19 has a circular cross-section slightly greater than the slot width which flexes the strip 22 between the two slots and thereby produces a resilient clamping force on the stud due to the inherent resiliency of the material composing the strip. This clamping force on the stud resists closing movement of case shells onto each other so that they cannot be inadvertently slammed onto each other and thereby possibly injuring the user's fingers.

Also, as can be seen best in FIG. 5, the ends of the slot 19 are larger as at 30 and 31 than the width of the remainder of the slot and in that way providing two positions where the stud can be located without distending the strip 22. When the case is fully opened and stud 27 is positioned in the enlarged slot end 30, the case is releasably locked against inadvertent closing by the slot walls having moved to a width underneath the stud less than the stud cross-section. To close case part 11 on 12, sufficient force will have to be applied to case part 11 to force the stud into the slot separating strip 22 from the opposite wall of slot 19.

For the description of an alternative embodiment, reference is made to FIG. 7, where as in the first described embodiment, a typical business paper luggage case, attache case or briefcase, is shown generally as at 10, and includes a pair of luggage case parts or shells 11 and 12 related together along a common edge by a hinge 13 permitting the case parts to be closed and opened onto each other. The alternate form of brace or stay 32 is interconnected adjacent the hinge 13 to the internal walls of the case end walls and serves to releasably lock the cases in the open position depicted in FIG. 1, and during closing to provide sufficient resistance to the closing movement to prevent the case parts slamming onto each other possibly injuring the fingers of the user. Moreover, the construction of the stays or braces 14 and 32 are such that these will tend not to pinch or tear papers contained within the case, and, in addition, the braces only take up a minimum amount of space from the interior of the case when the case parts 11 and 12 are closed on each other.

Figure 8:
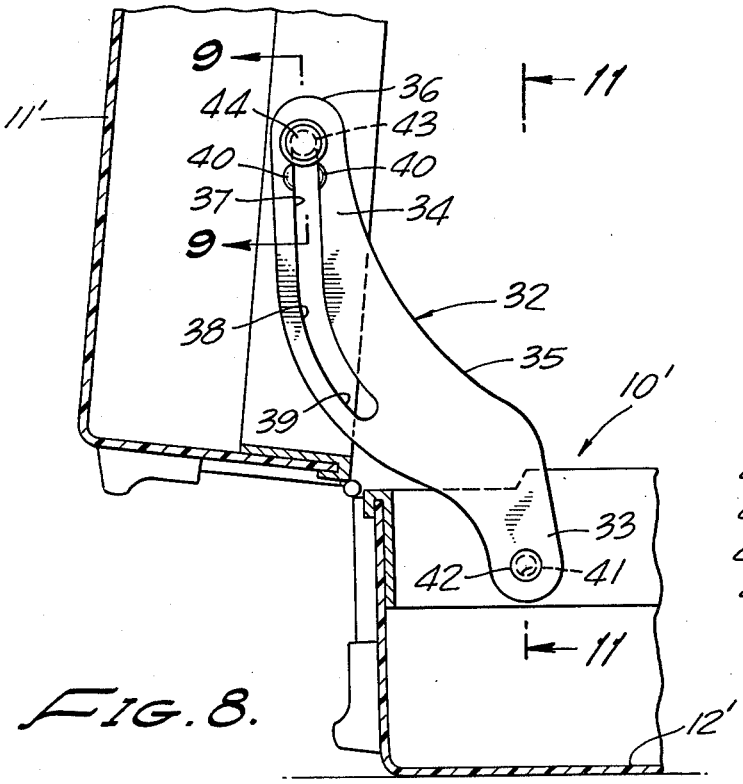
FIG. 8 is an elevational, sectional partially fragmentary view of the case and brace of FIG. 7.

As can be seen best in FIG. 8, the brace or stay 32 includes a metal plate having a first straight-line portion 33 and a second elongated curved portion 34 integral therewith. The straight-line portion extends along an axis that is spaced outwardly of the concavity 35 of curved portion 34 thereby locating the end 36 eccentrically with respect to 33.

The curved portion 34 of the plate 32 includes an elongated slot 37 having a relatively straight-line portion extending from a position immediately adjacent the end 36 to the point 38 which has a total length of approximately one-third the entire length of the brace 32 and the centerline of which on extending outwardly of the end 36 approaches the axis through 33 at a small angle. The slot continues on past 38 in the curved portion 39 which turns toward the brace straight-line portion 33 and has a length slightly less than that of the slot straight-line portion.

Figure 9:
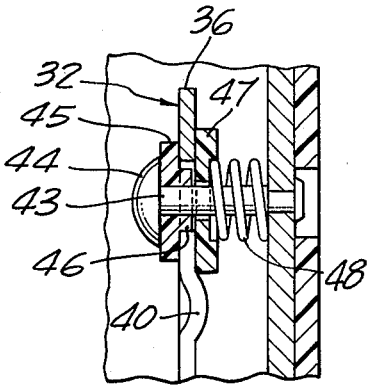
FIG. 9 is a sectional, elevational view taken along line 9—9 of FIG. 8.
Figure 10:
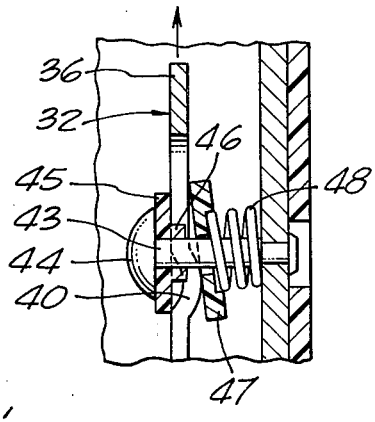
FIG. 10 is a view similar to FIG. 9 showing the case parts opened part way.

The plate walls defining the slot 37 are formed at a point spaced from the slot end adjacent the brace end 36, to provide a thickened part or stop 40 which extends from one side of the general plane of the brace plate (FIGS. 9 and 10).

The brace straight-line portion 33 includes an opening 41 which is rotatably received onto a stud 42 affixed to the inner end wall of the case part 12 and extending inwardly of the case generally parallel to the axis of hinge 13.

A further stud 43 is secured to the inner end wall of the case part 11 adjacent to the hinge and extending generally parallel thereto. The stud 43 passes through the slot 37 and includes an oversize head 44 that prevents removal of the brace from the stud. A washer-like bearing 45 (e.g., made of nylon) received on the shank of stud 43 has a large diametral portion separating the stud head 44 from the brace plate and a smaller diametral portion 46 which extends into the slot 37. A generally flat disc-like washer 47 of diameter greater than the slot width is also positioned on the stud shank and is continuously urged against the brace plate by a coil spring 48. More particularly, the spring is compressingly carried by the stud shank with one end contacting the inner wall surface of 11 and the other end located within a suitably formed groove in the face of washer 47.

In use, and beginning with the case parts 11 and 12 closed on each other as FIG. 13, as the case part 11 is moved away from part 12 the brace 32 rotates on stud 42 and the other stud 43 moves along the slot 37 toward the outer brace end. On further opening movement, this action continues until the washer 47 passes over the stop 40 (FIG. 10) and is lockingly located at the slot outer end (FIGS. 7, 8, and 9). The exertion of the spring on the washer 47, and thus onto the brace, maintains the case in open condition until sufficient closing force is applied to move the washer 47 back over the stop 40. Also, the spring provides sufficient clamping force on the brace throughout opening as to prevent slamming of the parts together. Moreover, as a result of the brace geometry it is maintained closely adjacent the case part end walls at all times and the brace extends only minimally into the space between the abutting case part edges (cf., FIGS. 12 and 13).

In the practice of the present invention, there is provided a luggage brace for limiting the open condition of the luggage shells to a prescribed maximum, and for controlling the rate of closure of the shells on each other, so as to reduce the possibility of pinching the fingers of the user. Also, through an eccentric construction of the brace and the special shape of the slot within which a mounting stud is slidingly received, the brace is prevented from moving into that case part that would normally be the lower one and in which papers, documents and the like are carried during opening and closing of the case.

Although the invention herein has been described particularly in relation to its use in a business paper case or so-called attache case, it is contemplated that it would be equally advantageous in other types of carrying cases, such as sample cases or conventional luggage. That is, wherever carrying case parts are desired to be related to one another in a manner that would prevent their being opened beyond a certain predetermined maximum and closing would be at a sufficiently slow rate as to prevent inadvertent injury to the user, the described brace in both of its versions, could be advantageously employed and its use in that manner would be considered within the spirit of the invention.

I claim:

1. Apparatus for controlling the rate and extent of opening and closing a case having first and second case shell parts hinged to one another, comprising:

a plate having an elongated slot of substantially uniform width and an opening;

a first stud affixed to an inner surface of said first case shell part extending generally parallel to the hinge, which stud is rotatably received within said plate opening;

a second stud received through the slot and affixed to an inner wall of said second case shell part and terminating outwardly of said slot in an enlarged head, said second stud extending generally parallel to said first stud;

first bearing means rotatively received on the outer end of said second stud including a first portion of diameter greater than the slot width contacting the second stud enlarged head and a smaller diametral portion slidingly received within the slot;

second bearing means of diameter greater than the slot width received on the second stud with a smooth major surface facing the plate and a recessed major surface facing away from said plate; and a coil spring on said second stud having parts received within the second bearing means recess and continuously resiliently urging said second bearing means against the plate to provide a resilient clamping force on the plate resisting sliding of said second stud along the slot.

2. Apparatus as in claim 1, in which the plate portions defining the slot are formed closely adjacent an end of the slot to form a stop that is substantially thicker than the remainder of the plate.

3. Apparatus as in claim 1, in which the plate has a straight-line portion integrally related with a curved portion, the plate opening being located in the straight-line portion and the slot being located in the curved portion.

* * * * *